United States Patent [19]

Berkestad et al.

[11] 4,339,249

[45] Jul. 13, 1982

[54] HEAT EXCHANGER FOR RECOVERY OF HEAT ENERGY FROM DUST-CONTAINING WASTE GASES

[75] Inventors: Karl-Erik Berkestad; Lennart Danielsson; Erik Henriksson; Torsten Svensson; Artur Östlund, all of Linköping, Sweden

[73] Assignee: Stal-Laval Apparat AB, Linköping, Sweden

[21] Appl. No.: 963,734

[22] Filed: Nov. 27, 1978

[30] Foreign Application Priority Data

Nov. 30, 1977 [SE] Sweden ..... 7713541

[51] Int. Cl.[3] ..... B01D 51/00

[52] U.S. Cl. ..... 55/269; 432/67; 122/336

[58] Field of Search ..... 55/1, 80, 267–269, 55/DIG. 30; 122/477, 20 B, 7 C, 235, 336; 432/67

[56] References Cited

U.S. PATENT DOCUMENTS

| | | | |
|---|---|---|---|
| 704,009 | 7/1902 | Ebersole | 122/20 B |
| 1,848,130 | 3/1932 | Jacobus | 55/269 |
| 1,865,852 | 7/1932 | Goldhagen | 122/20B |
| 2,257,721 | 9/1941 | Dufault | 122/20 B |
| 2,623,505 | 12/1952 | Armacost | 122/336 |
| 3,485,048 | 12/1969 | Miliarus | 122/477 |
| 3,844,233 | 10/1974 | Fishback | 122/20 B |
| 4,037,567 | 7/1977 | Torres | 122/20 B |

*Primary Examiner*—Norman Yudkoff

*Attorney, Agent, or Firm*—Watson, Cole, Grindle & Watson

[57] ABSTRACT

A heat exchanger for recovering the heat energy content in furnace waste gases and for recovering much of the dust entrained therewith includes a hollow duct through which the waste gases pass, and which contains first and second tube bundles arranged one after the other and a dust collection surface therebetween. The heat content in the waste gases is transferred to water passing through the two tube bundles and dust is deposited on the dust collection surface.

7 Claims, 3 Drawing Figures

HEAT EXCHANGER FOR RECOVERY OF HEAT ENERGY FROM DUST-CONTAINING WASTE GASES

BACKGROUND OF THE INVENTION

The present invention relates to heat exchangers, and more specifically to heat exchangers which are capable of recovering the heat energy contained in waste flue gases generated in industrial furnaces.

Due to the increasing costs associated with the generation of heat and electricity for operating industrial plants and the concurrent desire to reduce pollutent emission (including heat emission) into the surrounding atmosphere, the recovery of the heat content in the waste flue gases generated in industrial processes has become an increasingly desirable goal. One problem with achieving such energy recovery, however, has been the fact that dust usually is contained in such waste flue gas streams, and this dust tends to clog the flanges in the fins, flues, exhaust outlets, etc., of heat exchangers positioned in the flue gas ducts.

The present invention is aimed at the construction of a heat exchanger which can be effectively used in a flue gas duct to recover the energy values contained in the waste gas streams passing therethrough and for concurrently recovering much of the dust contained therein.

SUMMARY OF THE INVENTION

According to the present invention, the heat exchanger includes two separate tube bundles arranged one after the other in the direction of flow of the waste gas stream through which a suitable heat-absorbing fluid (i.e. water) is caused to flow, and a dust collection surface positioned between the tube bundles on which much of the dust contained in the waste gas stream will collect. Only the second tube bundle will have the conventional heat exchange fins, and since most of the dust will have been removed from the waste gas stream prior to contact with the second tube bundle, clogging thereof with dust will not occur.

The structural features of the heat exchanger of the present invention provide for the recovery of the heat energy content, as well as much of the dust, in dust-containing hot waste gas streams as follows: the dust-containing hot waste gas stream is first passed through the first tube bundle wherein much of its heat energy content is transferred to the fluid passing through this first tube bundle, then a major amount of the dust, i.e., the coarse dust, contained in the waste gas stream is deposited on the dust collection surface, and finally the waste gas stream is passed through the second tube bundle wherein an additional amount of heat energy is transferred to the fluid passing through this second tube bundle.

Although the dust-containing waste gases which enter the heat exchanger may be at a temperature as high as 800 ®–1000° C., after passage through the first tube bundle the temperature will be reduced to a much lower temperature, e.g. 400°–450° C., and at this lower temperature it is much easier to separate the dust from the waste gas stream. Removing the dust prior to the time the waste gas stream contacts the second tube bundle is advantageous since only the second tube bundle will include finned tubes and thus, due to the narrow spaces inherent therein, be subject to clogging with dust particles.

Thus, in a preferred embodiment of the present invention, the first (upstream) tube bundle is constructed of a smooth-surfaced tube (or tubes) and the second (downstream) tube bundle of a flanged tube (or tubes). In addition, the heat exchanger will have a U-shaped configuration for the hollow ducts through which the waste gas stream will flow, the two tube bundles being respectively positioned in the opposite straight duct sections. The dust collection surface will be formed by the floor portion of the hollow bottom interconnecting portion between the straight duct sections. Due to the 180° C. change of direction which the waste gas stream must undergo, the entrained dust, especially coarse dust, will be efficiently deposited thereon and thus be effectively separated from the waste gas stream.

Further features and advantages of the present invention will be apparent from the arrangement and construction of the embodiments of the heat exchanger depicted in the accompanying drawing and discussed in the following description.

DESCRIPTION OF THE PREFERRED EMBODIMENTS

Figure 1:
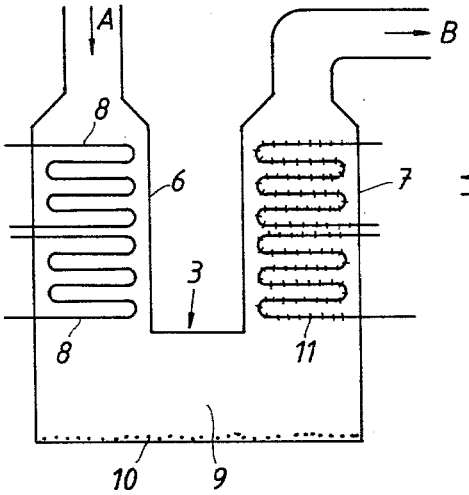
FIG. 1 shows a schematic cross-sectional side view of a heat exchanger in accordance with the present invention.

As shown in FIG. 1, the heat exchanger in accordance with the present invention includes a generally U-shaped duct system formed by two opposite hollow straight duct sections 6,7 which are interconnected by a hollow bottom portion 9, and first and second tube bundles 8,11 which are respectively positioned in the opposite hollow duct sections. A hot waste gas stream enters section 6 as indicated by arrow A and leaves section 7 as indicated by arrow B. Tube bundle 8, which may in fact comprise a multiplicity of tube lines constructed in a serpentine fashion as shown in FIG. 1, is composed of smooth surfaced pipes; whereas tube bundle 11, which may in fact comprise a multiplicity of tube lines constructed in a serpentine fashion as shown in FIG. 1, is composed of pipes which include perpendicularly extending heat exchange fins.

As the entering dust-containing hot gases pass through tube bundle 8, they transfer some of their heat content to the fluid (water) passing through bundle 8 and thus become cooled, whereas the fluid (water) becomes heated, e.g. evaporated, and in fact superheated. As the dust-containing hot gases pass through bottom section 9 and change their direction of flow by 180° C., entrained dust 10 (both coarse and fine dust particles) will be separated from the waste gases and deposited on the bottom surface of section 9. This dust can be periodically removed by mechanically or pneumatically-activated removal means (not shown) or by manually applying scrapers or the like along the collection surface. The waste gases which have already been somewhat cooled and purified of much of their entrained dust will pass through tube bundle 11, where they will transfer more of their remaining heat content to the fluid (water) passing through bundle 11 and thus become further cooled. The fluid (water) flowing through bundle 11 will become heated, and possibly evaporated into steam.

Due to the fact that the initial dust-containing hot waste gases have been cooled prior to entering bottom section 9, the material used to form this section will be subjected to less heat stresses than would be the case otherwise. In addition, due to the fact that the waste gases will have had some of the extrained dust therein removed prior to passage through finned tube bundle 11, no deposition (and clogging) of the narrow spaces between the fins will occur.

Figure 3:
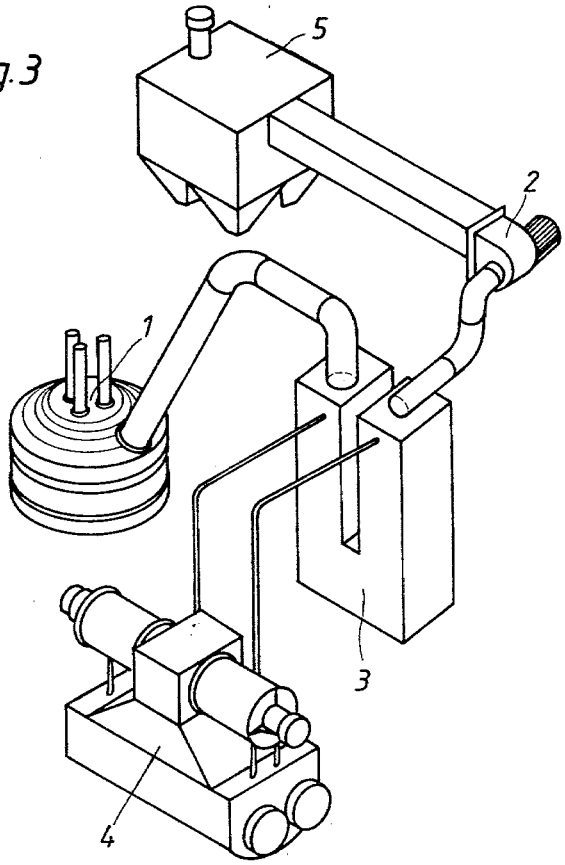
FIG. 3 shows a perspective view of a heat exchanger in accordance with the present invention in its interconnection with a waste gas flue system and a heat-recovery steam turbine.

As shown in FIG. 3, the waste flue gases are pumped from a furnace (e.g. a metallurgical furnace such as an arc furnace) through the inventive heat exchanger 3, and to a filter 5 by way of a pump 2. Water, which enters the heat exchanger at a temperature of about 120° C. and a pressure of 20 bar or more, is heated in the heat exchanger to form steam or superheated steam, and is circulated to drive a steam turbine 4. Filter 5 acts to separate the remainder of the entrained dust from the waste gases, the filter being protected from excessive temperatures due to the fact that the waste gas stream leaving the heat exchanger will have a temperature of only about 150° C.

Figure 2:
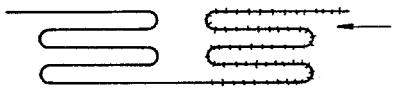
FIG. 2 shows a schematic side view of an alternative arrangement for the first and second tube bundle interconnection as compared to that depicted in FIG. 1.

Although each of the tube bundles 8 and 11 may comprise a single tube with a serpentine shape within the heat exchanger, as depicted in FIG. 1 each tube bundle may in fact comprise a multiplicity of tube lines (only two are shown) which each has a serpentine shape within the heat exchanger. Each tube line may be separately connected to a steam turbine. As shown in FIG. 2, however, the tube lines may be connected in series, i.e., tube lines in the first and second tube bundles may be serially connected, with the fluid to be heated caused to flow therethrough in a counter-current fashion to the flow of heated waste gases.

While there has been shown and described what is considered to be some preferred embodiments of the present invention, it will be obvious to those skilled in the art that various changes and modifications may be made therein without departing from the invention as defined in the appended claims.

We claim:

1. A heat exchanger for the recovery of heat energy in dust-containing hot waste gases, said heat exchanger comprising means forming a hollow duct through which the hot dust-containing waste gases flow, at least one first pipe positioned within said hollow duct, each said first pipe having a smooth outer surface and being capable of carrying a heat-absorbing fluid therethrough, each said first pipe having a serpentine configuration, at least one second pipe positioned within said hollow duct, each said second pipe having fins on the outer surface and being capable of carrying a heat-absorbing fluid therethrough, each said second pipe having a serpentine configuration, and means forming a dust collection surface located between said first and second pipes.

2. A heat exchanger of claim 1 including only one said first pipe and only one said second pipe.

3. The heat exchanger of claim 1 including a multiplicity of smooth-surfaced first pipes which each has a serpentine configuration, and a multiplicity of second pipes with fins on the outer surfaces thereof, each of said multiplicity of pipes having fins having serpentine configurations.

4. The heat exchanger of claim 1 including means for connecting each of said first pipes with a said second pipe such that the heat-absorbing fluid is capable of passing through said second pipe and then said first pipe.

5. The heat exchanger of claim 1 wherein said hollow duct is generally U-shaped with two opposite hollow straight duct sections and an interconnecting hollow bottom section, each of said first pipes being positioned in one of said two opposite hollow straight sections and each of said second pipes being positioned in the second of said two opposite hollow straight sections.

6. The heat exchanger of claim 5 wherein said means forming a dust collection surface comprises the floor portion of said interconnecting hollow bottom section.

7. The heat exchanger of claim 1 wherein each of said first and second pipes have inlet and outlet portions which extend through the means forming said hollow duct to connect to a steam turbine.

* * * * *